United States Patent [19]

Ward

[11] 4,039,994

[45] Aug. 2, 1977

[54] VARIABLE OUTPUT FUNCTION POTENTIOMETER

[75] Inventor: Frank L. Ward, Kensington, N.H.

[73] Assignee: Clarostat Mfg. Co., Inc., Dover, N.H.

[21] Appl. No.: 684,062

[22] Filed: May 6, 1976

[51] Int. Cl.[2] ..... H01C 10/04

[52] U.S. Cl. ..... 338/89; 338/162; 338/174; 338/176; 338/194

[58] Field of Search ..... 338/89, 91, 92, 93, 338/123, 125–127, 157–158, 160, 162, 167, 170, 174, 176, 183, 188, 194, 327, 332, 324, 325

[56] References Cited

U.S. PATENT DOCUMENTS

| | | | |
|---|---|---|---|
| 2,871,328 | 1/1959 | Budd et al. | 338/183 |
| 3,613,042 | 10/1971 | Leerkamp | 338/194 |
| B 528,761 | 2/1976 | Smith | 338/176 |

*Primary Examiner*—C. L. Albritton

[57] ABSTRACT

A variable output function double bias potentiometer having first and second low resistance zones to provide two bias voltages and a high resistance zone with which output means are in contact to provide an output function which can be freely varied between the two bias voltages.

4 Claims, 8 Drawing Figures

FIG. 7
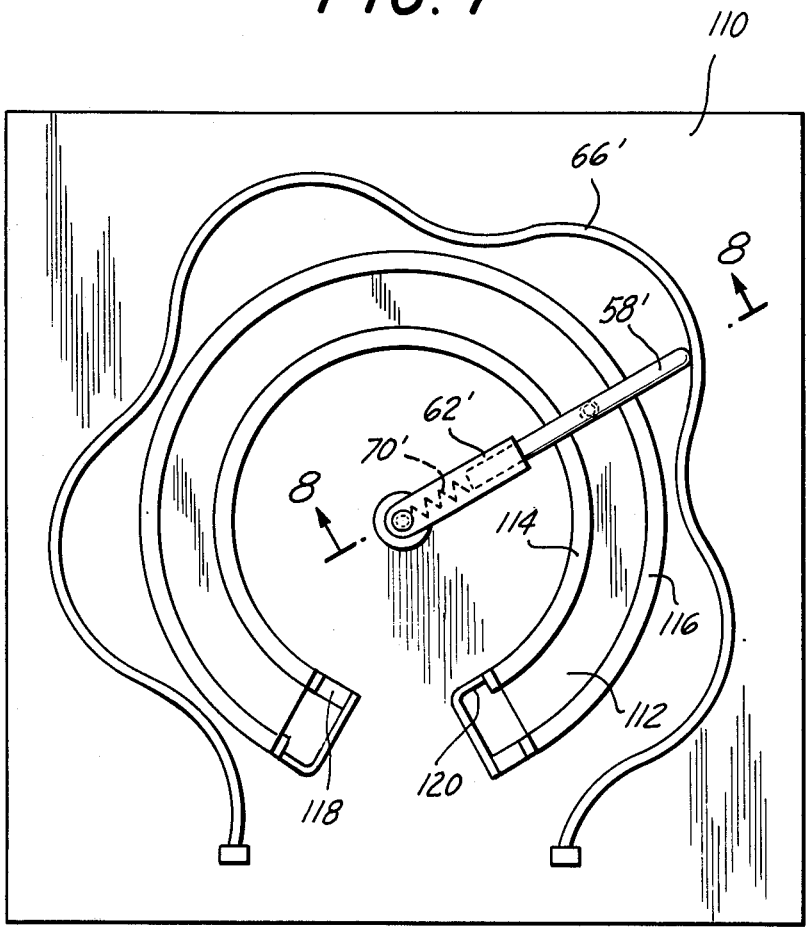
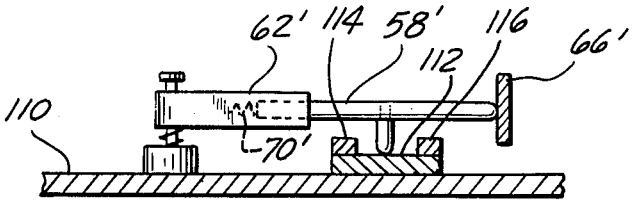
FIG. 8

VARIABLE OUTPUT FUNCTION POTENTIOMETER

BACKGROUND OF THE INVENTION

Potentiometers having resistance elements along which a wiper is moved to provide a voltage output are well known. Nonlinear potentiometers are those in which the voltage output varies nonlinearly as the wiper is moved from an end termination. Nonlinear potentiometers can be used to develop various curves at the output. One of the major undersirable aspects of curve fitting to the use of nonlinear potentiometers is that for the most part the nonlinear function is provided in the potentiometer unit in advance and little or no flexibility is available for varying this.

There are frequent applications where two bias configurations are desirable such as in cable television where it is necessary to set a number of preset voltages for channel selection with a tuner between two fixed biases. There is a requirement for a number of voltages to represent a number of channels. Presently a high resolution pot is used for each channel and no single potentiometer has been available. Additionally there are applications where a more general function between two fixed bias voltages must be generated to satisfy manufacturing tolerances over a range.

SUMMARY OF THE INVENTION

A potentiometer having a plurality of outputs, each of which provides a voltage value which is intermediate between two predetermined bias voltages including in combination a nonelectrical conducting substrate, a thin layer of high resistance material disposed on said substrate, first and second spaced layers of low resistance material disposed on said high resistance material, output means mounted on said substrate, wiper means of said output means in contact with said high resistance material and movable thereon through a path, first and second termination means and means for taking an output voltage between one of said termination means and said output means.

BRIEF DESCRIPTION OF THE DRAWINGS:

FIG. 7 is a plan view of still another alternate embodiment of the invention; and FIG. 8 is a partially sectional view taken along the line 8—8 in the direction of the arrows in FIG. 7.

DESCRIPTION OF THE PREFERRED EMBODIMENTS

Figure 1:
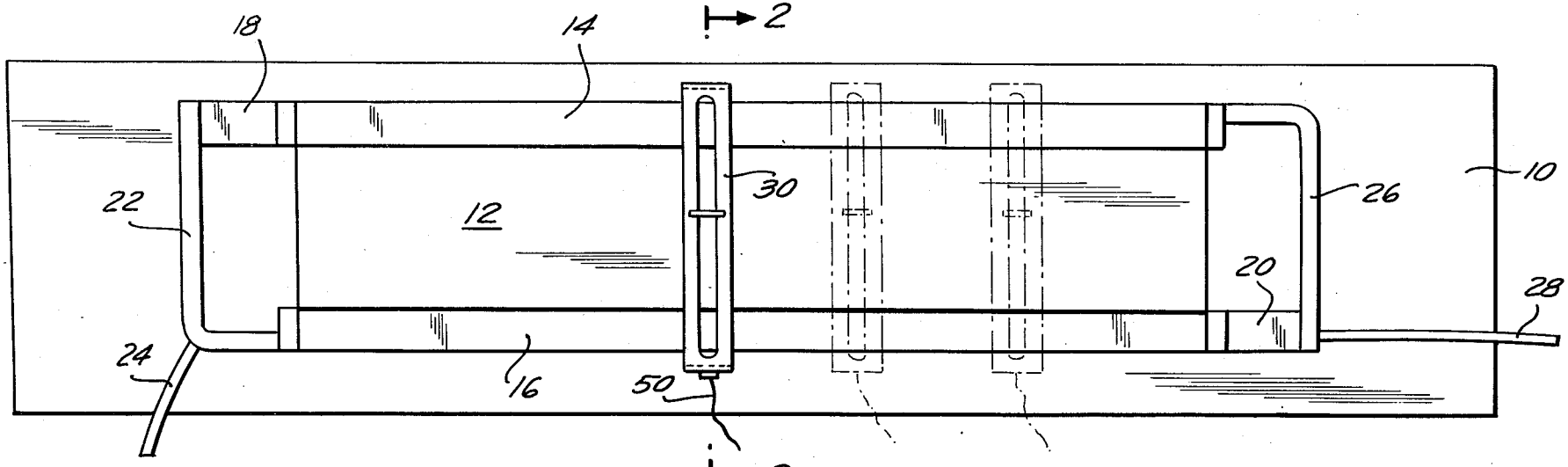
FIG. 1 is a plan view of a potentiometer constructed in accordance with the teachings of this invention.

In the Figs. a potentiometer constructed in accordance with the teachings of this invention is shown. The device includes a substantially rectangular substrate 10 formed of any suitable nonelectrically conducting material, such as a polyimide. A thin layer 12 of high resistance material such as a conductive plastic film is applied to the substrate in any desired fashion as by silk screening, for example. In the preferred embodiment of the invention the high resistance element 12 is applied by screening carbon loaded resin onto the substrate at a thickness of 1 to 1.5 mils. First and second spaced layers of low resistance material identified in FIGS. 1 and 2 by the numeral 14 and 16 respectively are disposed on the high resistance element 12. The low resistance elements 14 and 16 also consist of a carbon loaded resin and in the preferred embodiment are screened on the high resistance element 12 in rectangular form at a depth of approximately 1 to 1.5 mils. Additional low resistance elements 18 and 20 are applied directly to the substrate (not over the high resistance element) and these too can be screened on. Low resistance 18 is in contact with the high resistance 12 at one end thereof whereat the low resistance 14 has been screened on and conductor 22 which can be applied to the substrate by any suitable printed circuit technique and which can be copper, silver or any appropriate material, connects the remaining end of resistance 18 to the high resistance element 12 at the point whereat low resistor 16 is in contact therewith. A first termination means is provided connected to conductor 24. Likewise resistor 20 is in contact with the high resistance element 12 at the point whereat low resistor 16 overlies the same and the remaining end of resistance 20 is in contact with high resistance element 12 at the point whereat low resistance 14 overlies the same by means of conductor 26 which is similar to conductor 22. A second termination means 28 similar to the termination means 24 is provided in contact with conductor 26.

A plurality of spaced output members 30 are provided. Each member 30 is formed of electrically conducting material and has a bridging component 32 which extends transversely of the substrate bridging the resistor elements 12, 14 and 16 with ends anchored in the substrate as at 34 and 36. A channel is formed in the member 32 supporting wiper member 38 which is movable therein in contact with the high resistance element 12 which it can wipe or contact transversely thereof in a path determined by the position of bridge 32.

Figure 2:
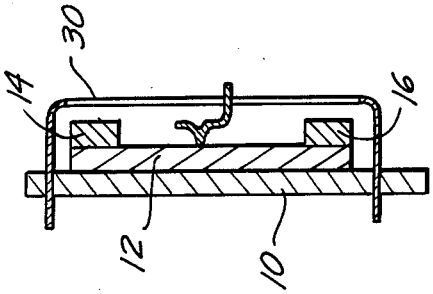
FIG. 2 is a sectional view taken along the line 2—2 in the direction of the arrows in FIG. 1.
Figure 3:
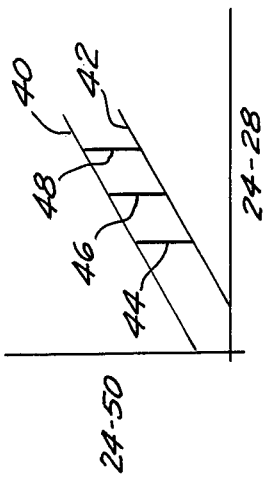
FIG. 3 is an illustrative curve providing examples of the output function achievable with the potentiometer shown in FIG. 1.

In FIG. 3 an illustrative curve is shown providing an example of the outputs that can be obtained from the unit shown in FIGS. 1 and 2 upon application of voltage between the termination members 24 and 28. Upon the application of voltage between members 24 and 28 curves indicated in FIG. 3 by the numerals 40 and 42 are achieved. These curves are predetermined or preset by the perimeters of the system including the fixed resistances 18 and 20. Each of the curves 44, 46 and 48 represent a function achievable by one of the output members 30 by taking a voltage between one of the termination members such as 24 and the output 50 of output member 30. As stated above, there is provided a plurality of output members 30 to achieve a plurality of curves such as 44, 46 and 48.

Figure 4:
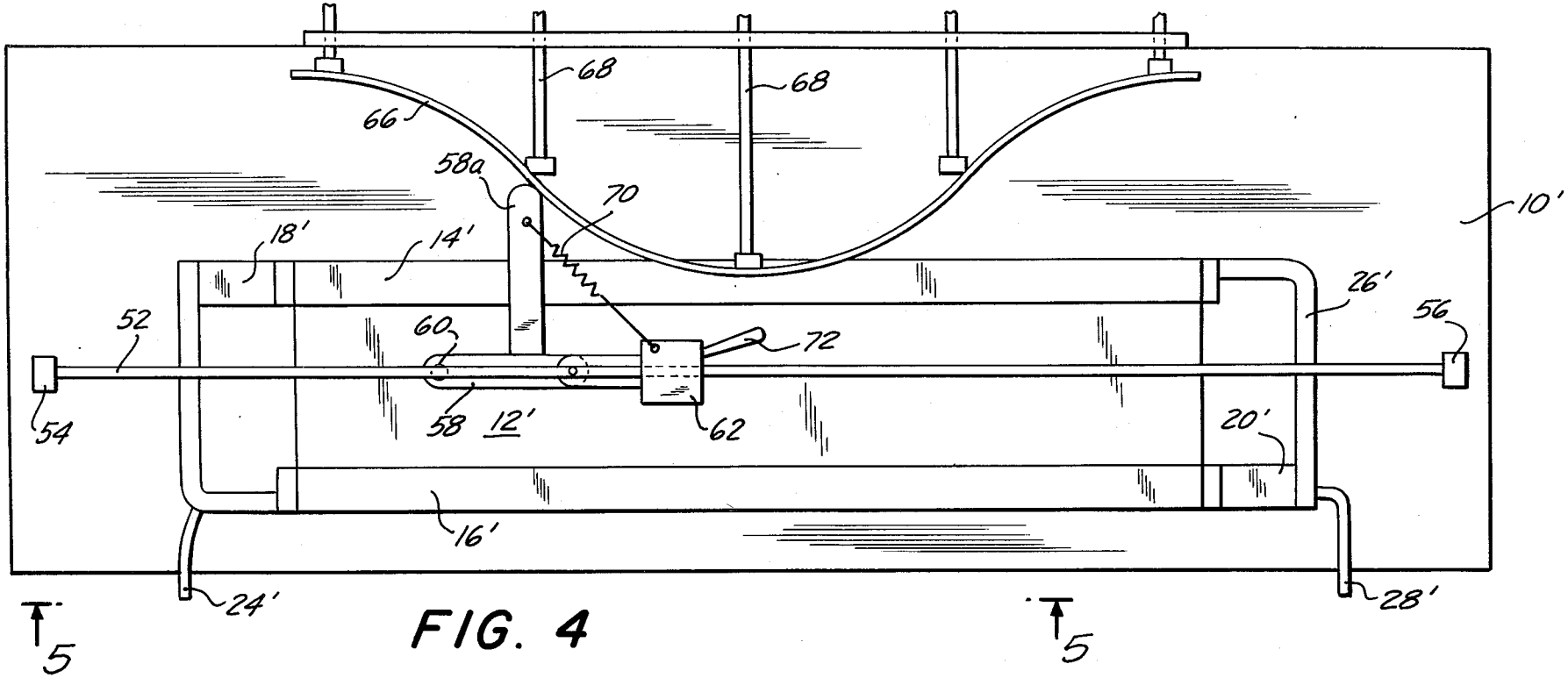
FIG. 4 is a plan view of an alternate embodiment of the invention.
Figure 5:
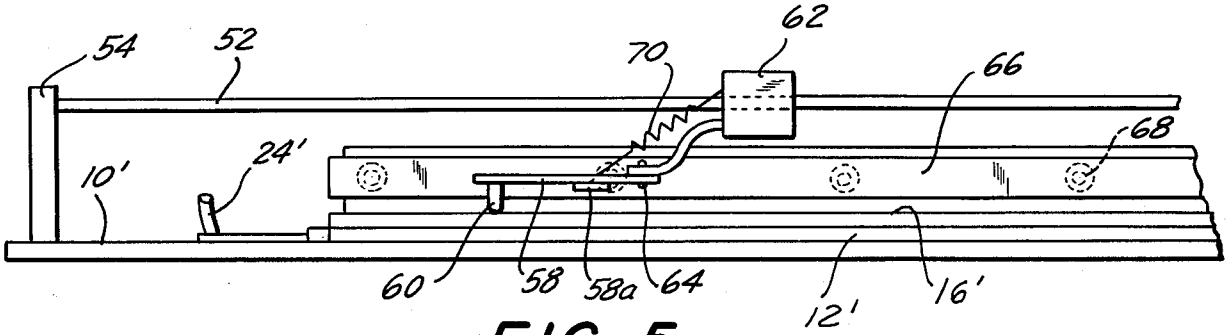
FIG. 5 is a partially sectional elevation of the potentiometer shown in FIG. 4 taken along the line 5—5 in the direction of the arrows in FIG. 4.

An alternate form of the invention is shown in FIGS. 4 and 5 wherein the substrate high resistance element, first and second low resistance elements, conductors and termination means are similar to those shown in the embodiment of FIG. 1 and given the same numeral designation with a prime following. Thus 10' represents the substrate, 12', 14' and 16' as well as 18' and 20' designate the high resistance element and low resistance elements respectively. The numerals 22' and 26' identify conductors and the numerals 24' and 28' identify termination means.

In the embodiment of the invention shown in FIGS. 4 and 5 however, the method and structure for taking the output voltage differs. A longitudinal bar 52 is provided supported above the high resistance element 12' by end posts 54 and 56 which are imbedded in the substrate 10'.

Figure 6:
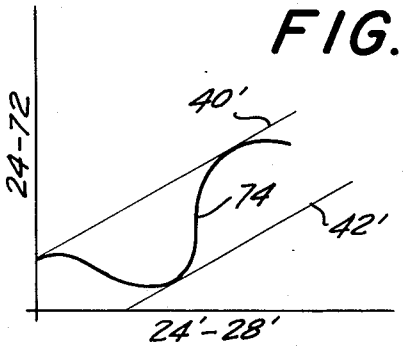
FIG. 6 is an illustrative curve showing the output function achievable with the potentiometer shown in FIG. 4.

A contact member 58 supporting contact 60 in wiping engagement with high resistance element 12' is supported on bar 52 by support member 62 which is suspended thereby with rod 52 passing through an opening in member 62 so that member 62 is movable longitudinally of high resistance element 12'. Member 58 is pivotally attached to member 62 at 64 and has an edge projecting therefrom which is indicated by the numeral 58'. Track 66 is supported on substrate 10' with cam surface defining members 68 projecting against track 66 and defining the path taken by track 66 which is a spring metal and easily distortable by movement of members 68. Projection **58*a* is spring pressed by spring member 70 and held against the track so that longitudinal movement of member 62 will result in contact 60 wiping the high resistance element 12' on a path defined by the cam member of track 66. In FIG. 6 there is plotted the output voltage taken across one of the termination means 24' and output 72 versus an input voltage across termination means 24' and 28'. The curves 40' and 42' are similar to the curves shown in FIG. 3 and established in the same way, that is, by the characteristics of the perimeters in the unit. The curve 74 however is defined by the track member 66 since it determines the transverse position of wiper 58 with respect to high resistance element 12'** in accordance with the longitudinal position of the output member at any given time.

A third embodiment of the invention is shown in FIG. 7. In this embodiment the substrate 110, high resistance element 112, low resistance elements 114 and 116 as well as low resistance elements 118 and 120 are similar in function and materials to the substrate 10, high resistance element 12 and low resistance elements 14, 16, 18 and 20 shown in FIG. 1. This embodiment is quite similar to that shown in FIG. 4 except that it provides for a rotary output member 58' having contact 60' in wiping engagement with the high resistance element 112 which in the embodiment of FIG. 7 is in circular configuration. The output member 58' is supported by support 62' and in a slot formed therein. It is spring pressed by spring 75 against circular track or cam member 66' so that rotation of the member 62' defines an output function similar to that shown in FIG. 6.

I claim:

1. A potentiometer having a plurality of outputs, each of which provides a voltage value which is intermediate between two predetermined bias voltages including in combination a nonelectrical conducting substrate, a thin layer of high resistance material disposed on said substrate, first and second spaced layers of low resistance material disposed on said high resistance material, first and second low resistance ends of said first layer of low resistance material, second and third low resistance ends of said second layer of low resistance material, a first low resistance element having an end in contact with said high resistance material beneath said first low resistance end, a first conductor electrically connecting the remaining end of said first low resistance element with said high resistance material beneath said third low resistance end, a second low resistance element having an end in contact with said high resistance material beneath said fourth low resistance end, a second conductor electrically connecting the remaining end of said second low resistance element with said high resistance material beneath said fourth low resistance end, output means mounted on said substrate, wiper means of said output means in contact with said high resistance material and movable thereon through a path, first and second termination means respectively connected to said first and second conductors and means for taking an output voltage between one of said termination means and said output means.

2. A potentiometer in accordance with claim 1 in which said output means includes a bridging portion mounted on said substrate which bridges said layers of resistance material, and a wiper member supported by said bridging portion in wiping contact with said high resistance material in a path determined by the position of said output means.

3. A potentiometer in accordance with claim 2 in which a plurality of output means are provided and each of which determines a separate path of transverse movement of a respective wiper member on said high resistance material supported thereby.

4. A potentiometer in accordance with claim 1 in which said output means includes first track means extending the length of the high resistance material, a wiper supported on said first track means for movement substantially throughout the length thereof, a second track means of predetermined configuration and spring means yieldingly urging said wiper against said second track means whereby the configuration thereof will determine the path of said wiper as it is moved in wiping engagement with said high resistance material along said first track.

* * * * *